US011088496B2

(12) United States Patent
Tarte et al.

(10) Patent No.: US 11,088,496 B2
(45) Date of Patent: Aug. 10, 2021

(54) MALE TO MALE ADAPTER

(71) Applicants: Stephen R Tarte, Tampa, FL (US); Michael E Stalzer, Tampa, FL (US)

(72) Inventors: Stephen R Tarte, Tampa, FL (US); Michael E Stalzer, Tampa, FL (US)

( * ) Notice: Subject to any disclaimer, the term of this patent is extended or adjusted under 35 U.S.C. 154(b) by 0 days.

(21) Appl. No.: 16/182,145

(22) Filed: Nov. 6, 2018

(65) Prior Publication Data

US 2019/0140406 A1 May 9, 2019

Related U.S. Application Data

(60) Provisional application No. 62/648,977, filed on Mar. 28, 2018, provisional application No. 62/582,471, filed on Nov. 7, 2017.

(51) Int. Cl.

| | |
|---|---|
| ***H01R 13/713*** | (2006.01) |
| ***H01R 24/28*** | (2011.01) |
| ***H01R 13/453*** | (2006.01) |
| ***H01R 13/66*** | (2006.01) |
| ***H01R 13/717*** | (2006.01) |
| ***H01R 24/30*** | (2011.01) |
| ***H01R 31/06*** | (2006.01) |
| ***H01H 47/00*** | (2006.01) |
| *H01R 103/00* | (2006.01) |

(52) U.S. Cl.

CPC ..... *H01R 13/713* (2013.01); *H01H 47/002* (2013.01); *H01R 13/4538* (2013.01); *H01R 13/665* (2013.01); *H01R 13/7135* (2013.01); *H01R 13/7172* (2013.01); *H01R 24/28* (2013.01); *H01R 24/30* (2013.01); *H01R 31/06* (2013.01); *H01R 13/717* (2013.01); *H01R 2103/00* (2013.01)

(58) Field of Classification Search

CPC ..... H01R 13/713
USPC ..... 307/139
See application file for complete search history.

(56) References Cited

U.S. PATENT DOCUMENTS

| | | | | |
|---|---|---|---|---|
| 3,553,428 | A | 1/1971 | McGhee | |
| 4,567,456 | A | 1/1986 | Legatti | |
| 5,118,301 | A * | 6/1992 | Bentivolio | H01R 13/7036 200/51.09 |
| 6,328,597 | B1 * | 12/2001 | Epps | H01R 13/4538 439/141 |
| 6,541,718 | B2 | 4/2003 | Burkholder et al. | |
| 7,029,312 | B2 * | 4/2006 | Reid | H01R 13/44 439/367 |
| 7,400,476 | B1 * | 7/2008 | Hull, Jr. | H02H 11/002 361/42 |
| 7,513,782 | B1 * | 4/2009 | Sheldon | H01R 13/652 439/106 |

(Continued)

OTHER PUBLICATIONS

Residual Current Circuit Breaker, Author unknown, Date Unknown.

*Primary Examiner* — Adi Amrany
(74) *Attorney, Agent, or Firm* — William Simmons; Simmons Patents

(57) ABSTRACT

The invention relates to the novel ornamental and utilitarian features of a module/adapter (e.g. male-to-male power adapter) for safety connecting the output interface of a backup power source (such as the outlet of a generator) with an electric circuit (such as a female duplex power outlet of a typical home). Such connection requires a male-to-male adapter which would be unsafe without the disclosed safety features.

9 Claims, 8 Drawing Sheets

(56) References Cited

U.S. PATENT DOCUMENTS

| | | | | |
|---|---|---|---|---|
| 7,626,283 | B1 * | 12/2009 | Baucum, Jr. | H02J 9/062 307/18 |
| 7,672,098 | B2 | 3/2010 | Zhang et al. | |
| 8,390,404 | B2 | 3/2013 | Zou | |
| D731,422 | S | 6/2015 | Aroimin | |
| 9,054,464 | B1 | 6/2015 | Lin | |
| 9,356,440 | B2 | 5/2016 | Aromin | |
| 9,419,417 | B1 * | 8/2016 | Taxter | H02B 1/28 |
| 2004/0169972 | A1 * | 9/2004 | Goss | H02J 3/005 361/84 |
| 2004/0235338 | A1 * | 11/2004 | Lee | H01R 24/28 439/490 |
| 2007/0120640 | A1 * | 5/2007 | Lee | H01H 73/303 337/37 |
| 2010/0008006 | A1 | 1/2010 | Satoru et al. | |
| 2011/0059623 | A1 * | 3/2011 | Capece | H01R 31/06 439/39 |
| 2012/0052702 | A1 | 3/2012 | Zou | |
| 2014/0321067 | A1 * | 10/2014 | Leeman | H02B 1/36 361/728 |
| 2016/0111876 | A1 * | 4/2016 | Cruz | H02J 3/12 307/43 |
| 2016/0336701 | A1 * | 11/2016 | Hopkins | H01R 24/22 |
| 2018/0174790 | A1 * | 6/2018 | Young | H01H 9/20 |

* cited by examiner

MALE TO MALE ADAPTER

CLAIM TO PRIORITY

This application claims priority to U.S. provisional application 62/648,977, filed on 28 Mar. 2018, and provisional application 62/673,224, filed on 7 Nov. 2017, which are incorporated by this reference for all that they disclose for all purposes.

TECHNICAL FIELD

The invention relates to novel ornamental and utilitarian features of a male-to-male power adapter with safety features configured to minimize the risk of a live voltage being present on an exposed male plug.

BACKGROUND OF THE INVENTION

As is well known, an electric utility is a company in the electric power industry that engages in electricity generation and distribution for sale in a regulated market such as the residential market. An electric power system is a group of generation, transmission, distribution, communication, and other facilities that are physically connected and collectively referred to as the "utility power grid".

All electrical equipment, including the power grid, will fail given enough time even under normal use. Power grid equipment failure can be caused by storms, trees, humans and wildlife. For example, electrical equipment can be weakened by events such as lightning strikes and temporary faults, such as those that happen when a tree limb comes in contact with a line. Over time, due to such events, power grid equipment becomes more susceptible to failure due to performance degradation which eventually results in such equipment not being able to withstand peak demands. Further, severe weather can cause outage situations that last for several days. For example, ice builds up on power lines, poles and tree limbs causing them to fall or break under the increased weight. Further, high winds can play a factor in how much weight a power line can sustain. Unfortunately, such failures often happen when people generally need power the most.

To address power grid failure problems, prior art methods include permanently installed home backup generators that operate automatically when a power failure is sensed. Such generators can run on diesel, natural gas and liquid propane (LP), and sit outside the home and look similar to a central air conditioning unit. The typical home backup generators deliver power directly to the home's electrical system, backing up the entire home or just the most essential items.

The problem is that very few homes in the United States have such backup systems for at least two reasons: (1) the US power grid is very dependable substantially reducing the need for such a system; and (2) generator backups are expensive ($5,000 to $10,000 installed). Couple (1) and (2) together and most people just do not see a need to invest the money in such a system. Yet, one day the power grid will fail and at such time people will wish they had such a backup system.

While most homes do not have a $10,000 backup system many do have, or can purchase upon need, a portable 11,000-Watt generator for between $700-$1000 dollars or a 4,000-Watt generator for $300 to $600 that can run 10 hours on a full tank of fuel at 50% load. Such a cost is doable for most people in the US when the need arises. Further, a list of typical power requirements for electric equipment found in the home includes (watts): microwaves 1300-start/1300-run (120V), refrigerators 1500-start/200-run (120 v), TVs 200-start/200-run (120 v), coffee makers 600-start/600-run (120 v), Electric Range 2100-start/2100-run (240V), and hot water heater 4500-start/4500-run (240V). Thus, in an emergency, one can purchase a $300 generator and easily power a refrigerator, TV, coffee maker, several LED lights and microwave if one can connect the power output of such generator to the home power gird (preferably safely). Purchase a 11,000-watt generator and one can even power a water heater and take hot showers.

The home has a "home power gird" fed by breakers that are connected to the utility company power grid. Notably, for a home power grid, many power outlets are connected to the same circuit and separated from the utility company power grid by a common breaker (i.e. the well-known breakers in your home breaker box). Thus, if one turns off such breaker and one connects a power source to the associated power outlet one can power all the electronic equipment connected to the circuit associated with such outlet.

Thus, there is a need to provide a means and method that allows a common person, who is not an electrician, without the help of an electrician, to SAFELY connect a temporary power source to a home power outlet during a power outage until the utility company restores power to the home. The disclosed technology addresses such issues.

SUMMARY OF THE INVENTION

Some of the objects and advantages of the invention will now be set forth in the following description, while other objects and advantages of the invention may be obvious from the description or may be learned through practice of the invention.

Broadly speaking, a principle object of the present invention is to provide a coupling adapter configured for electrically associating an output interface defined by a power generator with the same type output interface defined by an electrical circuit.

Yet another object of the invention is to provide a smart coupling device configured for electrically associating an output interface defined by a power generator with the same type output interface defined by an electrical circuit where the coupling adapter defines a plurality of safety features to reduce the risk of the user experiencing and electrical shock/injury.

Yet another object of the invention is to provide a smart coupling device configured for electrically associating an output interface defined by a power generator with the same type output interface defined by an electrical circuit where the coupling adapter defines a plurality of safety features to reduce the risk of the user experiencing an electrical shock/injury further comprising communication circuitry that allows remote monitoring and cycling of the smart coupler adapter.

Additional objects and advantages of the present invention are set forth in the detailed description herein or will be apparent to those skilled in the art upon reviewing the detailed description. It should be further appreciated that modifications and variations to the specifically illustrated, referenced, and discussed steps, or features hereof may be practiced in various uses and embodiments of this invention without departing from the spirit and scope thereof, by virtue of the present reference thereto. Such variations may include, but are not limited to, substitution of equivalent steps, referenced or discussed, and the functional, operational, or positional reversal of various features, steps, parts, or the like. Still further, it is to be understood that different embodiments, as well as different presently preferred embodiments, of this invention may include various combinations or configurations of presently disclosed features or elements, or their equivalents (including combinations of features or parts or configurations thereof not expressly shown in the figures or stated in the detailed description).

Those of ordinary skill in the art will better appreciate the features and aspects of such embodiments, and others, upon review of the remainder of the specification.

BRIEF DESCRIPTION OF THE DRAWINGS

A full and enabling description of the present subject matter, including the best mode thereof, directed to one of ordinary skill in the art, is set forth in the specification, which makes reference to the appended figures, in which.

Figure 1:
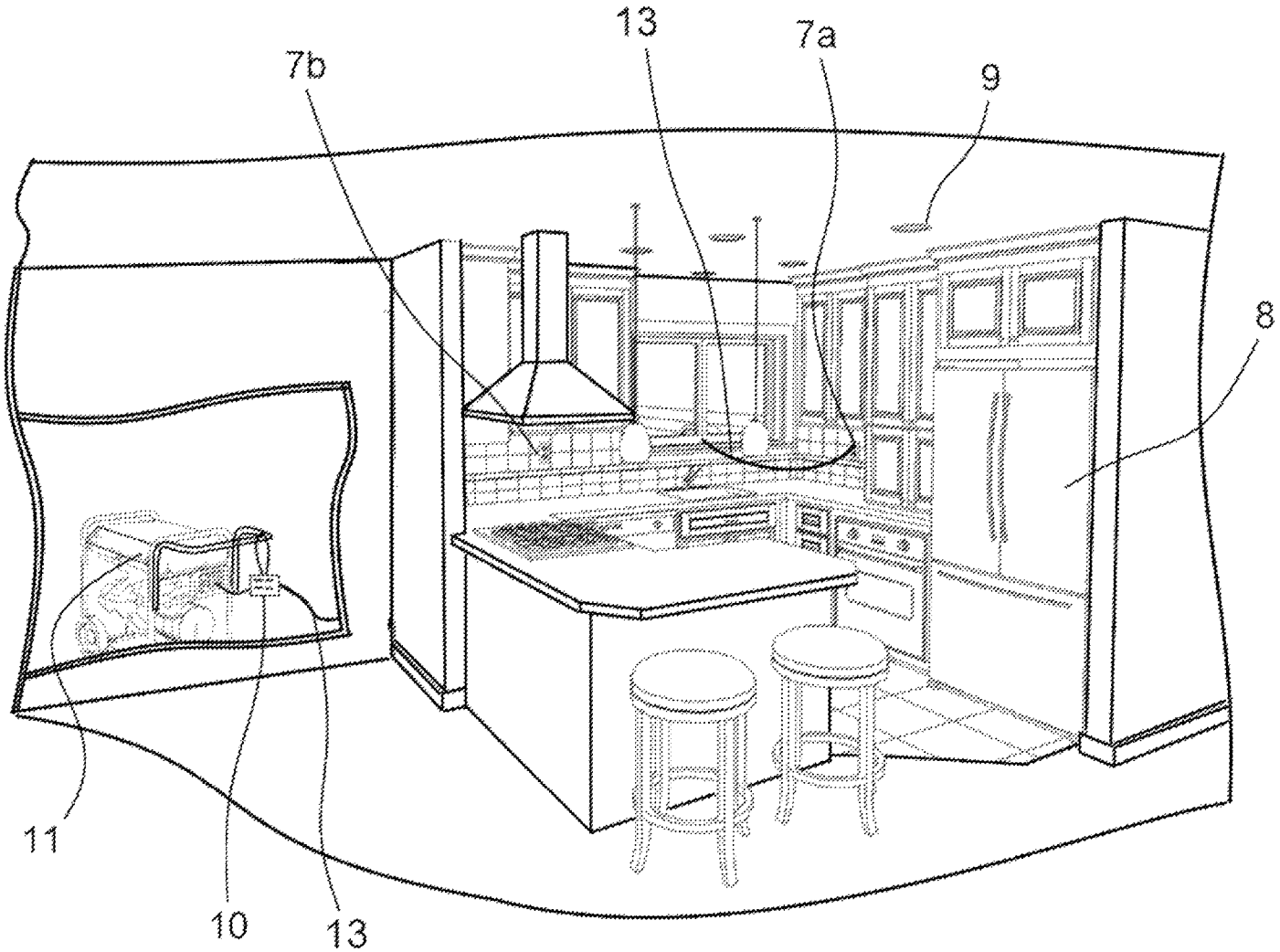
FIG. 1 is a perspective view of a typical residential kitchen powered by a portable power generator.

Repeat use of reference characters throughout the present specification and appended drawings is intended to represent the same or analogous features or elements of the present technology.

DISCLOSURE OF THE INVENTION

Detailed Description

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention covers such modifications and variations as come within the scope of the appended claims and their equivalents. Other objects, features, and aspects of the present invention are disclosed in or may be determined from the following detailed description. Repeat use of reference characters is intended to represent same or analogous features, elements or steps. It is to be understood by one of ordinary skill in the art that the present discussion is a description of exemplary embodiments only and is not intended as limiting the broader aspects of the present invention.

Construction Aids

For the purposes of this document two or more items are "mechanically associated" by bringing them together or into relationship with each other in any number of ways including a direct or indirect physical "releasable connections" (snaps, screws, Velcro®, bolts, clamps, etc.—generally connections designed to be easily, perhaps frequently, released and reconnected), "hard-connections" (welds, rivets, macular bonds, generally connections that one does not anticipate disconnecting very often if at all—a connection that is "broken" to separate), and/or "movable connections" (rotating, pivoting, oscillating, etc.).

Similarly, two or more items are "electrically associated" by bringing them together or into relationship with each other in any number of ways including: (a) a direct/indirect or inductive communication connection, and (b) a direct/indirect or inductive power connection. Additionally, while the drawings may illustrate various electronic components of a system connected by a single line, it will be appreciated that such lines may represent one or more signal paths, power connections, electrical connections and/or cables as required by the embodiment of interest.

For the purposes of this document, unless otherwise stated, the phrase "at least one of A, B, and C" means there is at least one of A, or at least one of B, or at least one of C or any combination thereof (not one of A, and one of B, and one of C).

As used herein, the terms "first," "second," and "third" may be used interchangeably to distinguish one component from another and are not intended to signify location or importance of the individual components.

Any two polygons are similar if their corresponding angles are congruent and the measures of their corresponding sides are proportional. Similar polygons have the same shape but can be different sizes. In this document circles are polygons.

This document includes headers are used for place markers only. Such headers are not meant to affect the construction of this document, do not in any way relate to the meaning of this document nor should such headers be used for such purposes.

Description

While the particulars of the present invention and associated technology may be adapted for use for any type electrical system, the examples discussed herein are primarily in the context of connecting a portable generator output with the 120-volt power outlet of a residential home.

Initially the configuration of a typical residential home wiring system/grid is considered. As is well known in the art, the wiring system of a residential home comprises a plurality of electric circuits connected to a "single phase" 120-volt/240-volt utility company power source through a set of breakers or fuses (while a home has two different 120-volt that can be said to define two phases—the come from a single phase service). A common residential circuit is protected by a 15-amp or 20-amp breaker, and thus, such circuit can supply 15/20 amps of current (15/20 means 15 or 20) before the breaker trips thereby stopping current flow. Notably high-power consumption devices such as ovens and water heaters can consume 30 amps of current (often at 240 volts), and thus, require 30-amp breakers and are typically supplied power through a dedicated circuit. In contrast, the 15/20-amp circuits are generally configured to supply power to a plurality of power outlets and/or a plurality of electric devices (e.g. lighting, TVs, Microwaves, etc.). The typical home will have at least five 15/20-amp circuits (often many more), and thus, the typical residential breaker box will comprise at least five 15/20-amp breakers protecting their respective circuits from overload.

The typical current requirements for common electric devices found in the home include (approximate numbers): a microwave: 10-amps, a refrigerator: 2-amps, a 120-watt light: 1-amp, a 12-watt LED light: 0.1-amps; a TV: 2-amps, and a coffee maker: 5-amps. Thus, one 20-amp circuit can easily supply power to a microwave, a refrigerator, at TV, a coffee maker and a plurality of LED lights.

Referring now to FIG. 1, a typical residential kitchen area is presented comprising a refrigerator (8) and a lighting system (9) electrically associated with a 15-amp electric circuit interface (7*a*, 7*b*,). A 15/20-amp output of a portable power generator (11) is depicted electrically associated with an electric circuit interface (7*a*) (e.g. 15/20 amp, 120 v home power outlet) through a coupling module (10) via a common power extension cord (13). Such configuration is presumably required due to a primary power service failure (e.g. utility company power failure) due to some event such as a snow storm, equipment failures, or an accident and such primary power outage may be expected to last for an extended period of time.

It should be appreciated that, for safety reasons, the power output interface (socket) of power generators (11) are female interfaces so that the power conductors cannot be easily touched (which would shock and harm humans). Similarly, the electric circuit interface (7*a*) in homes are female for the same reason. A male-to-male power cord would be needed to connect the power generator output interface with the electric circuit interface (7*a*); however, male-to-male power cords are not sold as such would be a disaster waiting to happen and would surely result in injury or death over time (unless they included the disclosed safety features). The coupling module (10) is used to provide a safe male-to-male interface to allow the generator (11) output to be safely coupled to outlet (7*a*) to temporarily power all the devices connected to the circuit supplying power (when main power is available) to the outlet (7*a*) until primary power can be restored.

Figure 2:
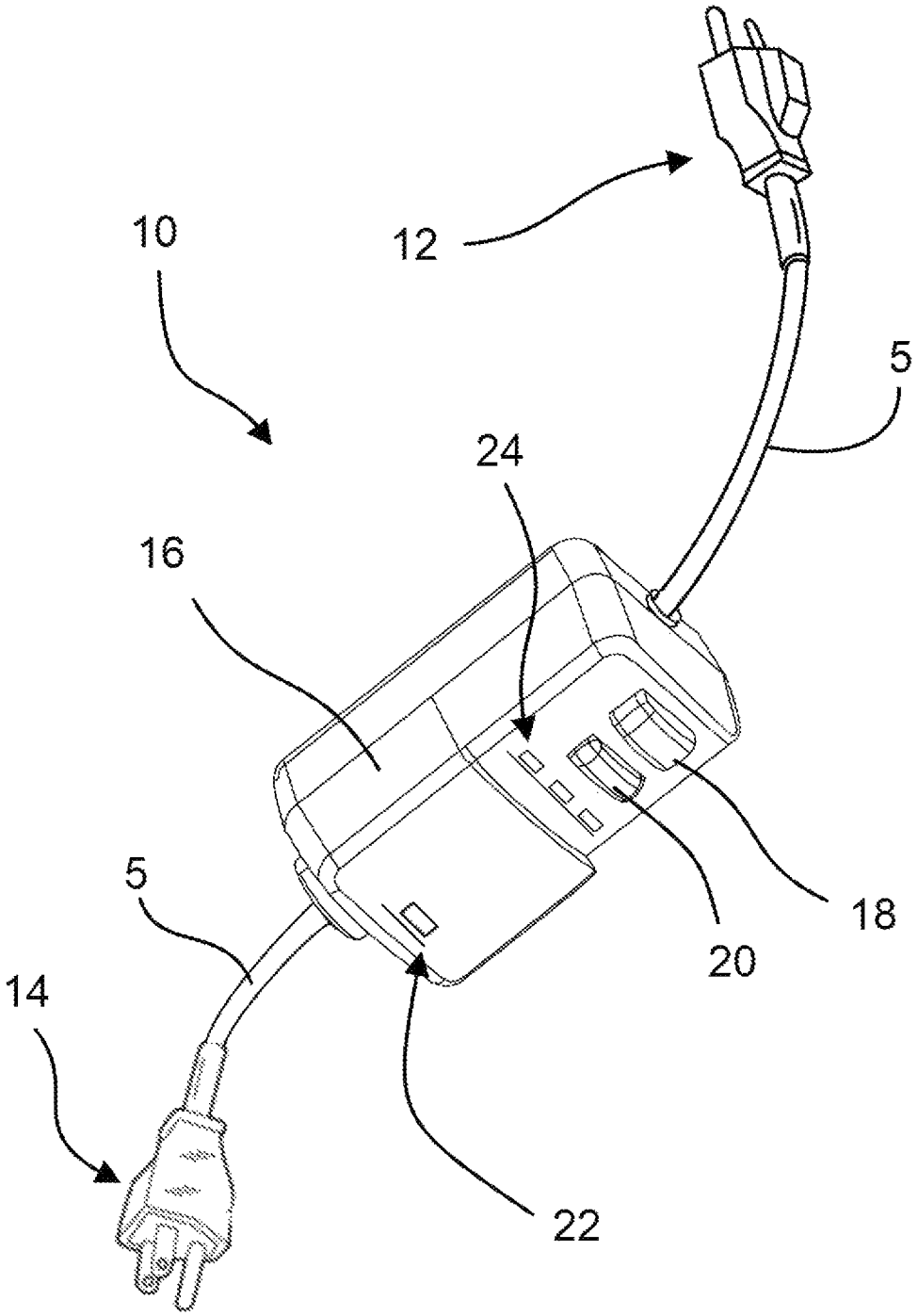
FIG. 2 is a perspective view of an exemplarily smart coupling module.

Referring now to FIG. 2, presented is one exemplary embodiment of a smart coupling module (10) for coupling the female output of a power generator interface (11) to a female electric circuit interface (7*a*). For the currently preferred embodiment, the smart coupling module (10) defines an input coupling element (12) and an output coupling element (14) electrically associated by a plurality of module conductors comprising at least a hot conductor, a neutral conductor and a ground conductor. Exemplary embodiments of input coupling element (12) and output coupling element (14) include the well-known 15/20 Amp 125-Volt three-conductor, double pole, with grounding plug, residential male connector. One exemplary embodiment of a power generator output (11) is a typical female power outlet and one exemplary embodiment of an electric circuit interface (7*a*) is the well-known 15/20-amp duplex outlet.

The input coupling element (12) is configured for being removably associated with a power generator output (11) and the output coupling element (14) is configured for being removably associated with an electric circuit interface (7*a*) (or the female input of an extension cord which is connected to an electric circuit interface). One of ordinary skill in the art will appreciate that other electrical service configurations fall within the scope and spirit of the present invention. For example, the neutral conductor may be replaced by a second hot conductor to define a 240-volt service.

For the embodiment depicted in FIG. 2, the smart module components are disposed inside a module housing (16) and input coupling element (12) and an output coupling element (14) are electrically associated with such module components via a conductor cable (5) comprising a plurality of conductors. The smart coupling module (10) further comprises a test activator (18) and a reset actuator (20) for testing and resetting the safety features of the module. For the currently preferred embodiment, such activators/actuators are buttons. The term "activator" simply means a typical push button (for example) and the term "actuator" simply means the button also resets a mechanical feature. The reset actuator (20) may be an activator for some embodiments. Status indicators (22, 24) are light generators configured to indicate the status of the smart coupling module (10) and/or the electrical status of the associated power systems.

For example, it would not be wise to connect the output coupling element (14) to an electrical circuit that already has power. Thus, status indicator (22) will generate a light-based signal when there is power present at the conductors for output coupling element (14) (once plugged into a "live" female socket). Similarly, one of the status indicators (24) generates a light-based signal when there is a voltage present at the conductors for input coupling element (12). Additionally, one of the status indicators (24) is configured to generate a light-based signal when some event has caused the safety circuits to activate the switching element (28) and uncouple the input coupling element (12) from the output coupling element (14). Such light-based signal could be referred to as a "fault". It should be appreciated that any type of status generators (light based, sound based, etc.) may be used but for the preferred embodiment such status indicators are low power consumption light emitters such as LEDs. Notably, the status generators may be incorporated into the activator/actuators (18, 20) as well as the coupling elements (12, 14).

Figure 4:
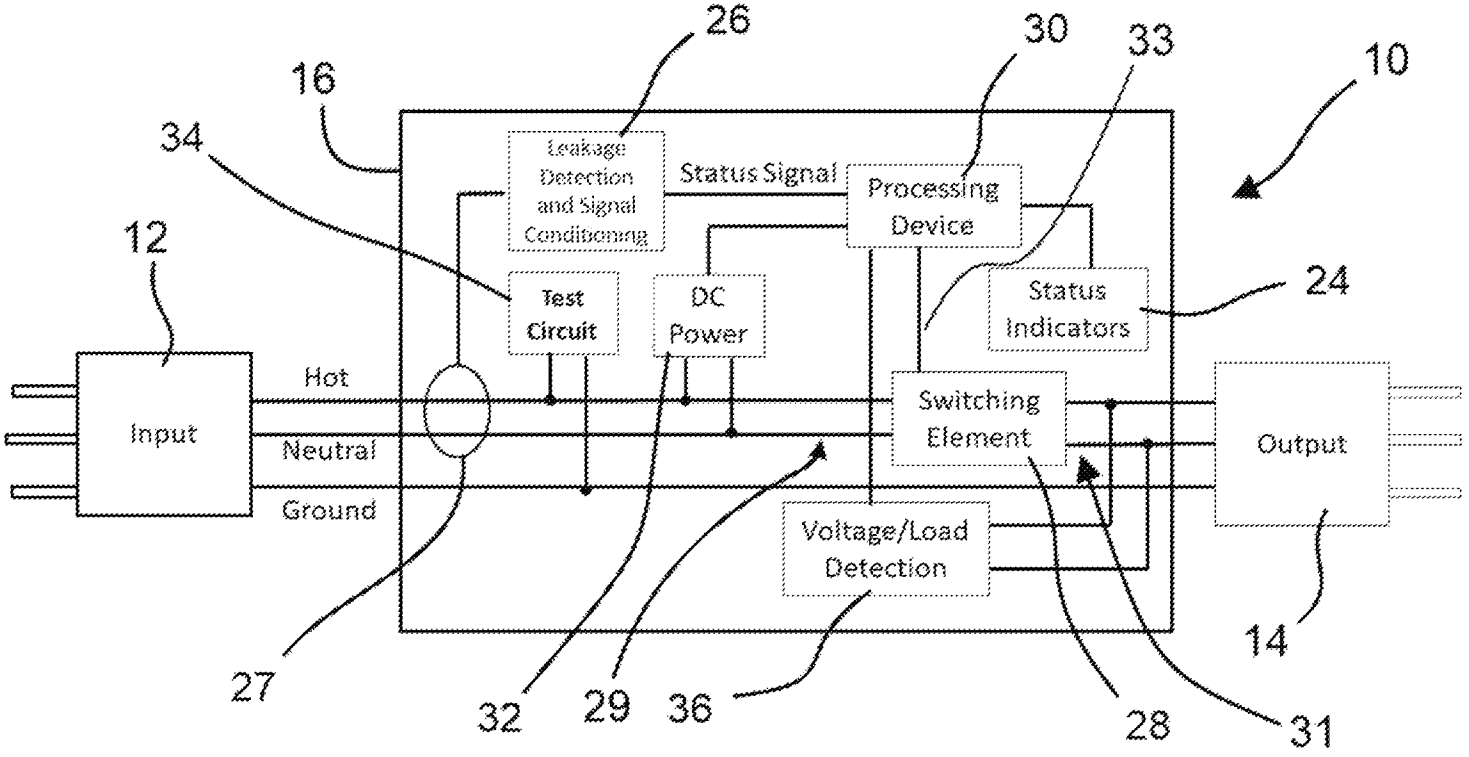
FIG. 4 is a block diagram representation of a smart coupling module.

Referring now to FIG. 4, a block diagram representation of one exemplary smart coupling module (SCM) (10) is presented. The SCM (10) comprises a switching element (28) defining a switching element input (29) and a switching element output (31) and a switch-signal-input (33). The switching element output (31) is electrically associated with the output coupling element (14). Notably, as will be described in more detail below, the unswitched-conductors are also electrically associated with the output coupling element (14).

At least one of the hot conductor and the neutral conductor are electrically associated with the switching element input (29) thereby defining at least one switched-conductor. For the currently preferred embodiment, both the hot conductor and the neutral conductor are electrically associated with the switching element input (29) thereby defining two switched module conductors. Notably, each conductor connected to the switching element input will have its own "switching element input" and its own respective output (i.e. the conductors are not shorted together at the input or the output of the switching module). For 240-volt systems the neutral conductor is replaced by a second hot conductor.

One of ordinary skill in the art will further appreciate that the module conductors not connected to the switching element input (29) each define an unswitched-conductor. There are few if any applications where one would isolate/switch the ground conductor. Thus, for the preferred embodiment, the ground conductor is not connected to switching element input (29) and defines an unswitched-conductor. Similarly, it is conceivable that one would not wish to disconnect the neutral conductor, and thus, for one alternative embodiment the neutral conductor is an unswitched-conductor.

For one configuration, the SCM (10) comprises a module housing (16) defining an input coupling element (12) and an output coupling element (14) electrically associated by a plurality of module conductors comprising a first conductor (e.g. hot), a second conductor (e.g. neutral or hot) and a ground conductor. The input coupling element (12) is configured for being removably associated with a power generator output interface (11) and the output coupling element (14) is configured for being removably associated with an electric circuit interface (7). For this embodiment the first conductor and the second conductor are electrically associated with a leakage current detector (26) through a sensor element (27). As before, a switching element (28) defines at least one switching element input (29) and at least one switching element output (31). As depicted in FIG. 4 there are two inputs and two outputs. For the current embodiment, the first conductor and the second conductor is electrically associated with a switching element input (29) thereby defining at least one switched-conductor (actually two switched-conductors). As before, the ground conductor defines an unswitched conductor. For a 240 Volt A.C. configuration, both the first conductor and second conductor define "hot" conductors and there is no neutral conductor. The switching element (28) further comprises a switch-signal-input (33) discussed in detail next.

Leakage Current Detector

The concept for the leakage current detector (26) is based on the idea that, for AC circuits, any current flowing through the hot conductor should also be flowing through the neutral conductor (120-volt configuration). The same is true for a 240-volt configuration where there are two hot conductors and no neutral conductor. If there is more current flowing through either the hot conductor or the neutral conductor such current difference is called leakage current. Still referring to FIG. 4, for the current embodiment, the hot conductor and the neutral conductor are electrically associated with a leakage current detector (26) via leakage sensor element (27). Such configurations are known in the art. For the embodiment depicted in FIG. 1, leakage sensor element (27) is configured to allow the leakage current detector (26) to detect when there is a difference in current between the hot conductor and the neutral conductor. One exemplary embodiment of a leakage sensor element (27) is a toroid core (such as the one depicted in FIG. 5). The leakage detector (26) conditions the signal generated by sensor element (27) to be compatible with the digital components such as a processing device. Consequently, one could refer to leakage detector (26) as a simple signal shaping circuit which may be incorporated into the sensor element (27) to define an integral element. Test circuit (34) simply creates a current imbalance when activated thereby triggering the leakage detector (26).

Electronics

As depicted in FIG. 4, the leakage detector (26) is electrically associated with processing device (30). Processing device (30) may be a microprocessor that supports standard operating systems and application software although other processing devices may be used such as ASICs (application specific integrated circuit) or ASSPs (application specific standard product). The processing device may comprise onboard ROM, RAM, EPROM type memories (133) for storing data and/or program code such as firmware. Processing device (30) may also comprise on-chip communication technology/circuitry (such as the ones manufacture by Microchip®) configured to transmit/receive a data signal to/from a remote electronic device. It should be appreciated that embodiments where the communication circuitry comprises a transceiver and/or only a transmitter fall within the scope of the invention. For one preferred embodiment, the communication circuitry consumes relatively low power and is configured to communicate with an external device that is expected to be within range of a low power transmitter signal. For example, for one embodiment the SCM (10) is in communication with home communication system (e.g. WiFi, Security, etc.). Because such a system is expected to be within close communication range of the SCM (10), the SCM (10) transmitter(s) can be relatively low powered thereby saving energy. That said, device modules with more powerful transmitters may be used including well known technologies for wireless communications such as GPRS, GSM, GPRS, 3G, and EDGE enabled networks as well as WAP networks. Consequently, for some embodiments, the communication circuitry may define common cell phone communication technology. Notably, such home communication electronics would likely need to be powered by the generator (11) when main power is lost.

Some embodiments may include both a low power transmitter and a high-power transmitter. For low power transceivers, (a low power transmitter relative to the above described "high power" communication circuitry), such transceiver may operate in any number of unlicensed bands although frequencies requiring a license may be used. Suitable technologies include Bluetooth and Zigbee (IEEE 802.15). Zigbee is a low data rate solution for multi-month to multi-year battery life applications. Zigbee operates on an unlicensed, international frequency band. Such technologies are known and understood by those skilled in the art, and a detailed explanation thereof is not necessary for purposes of describing the method and system according to the present invention. By way of example, the low power transmitter may provide communications with devices such as cell phones and may further be operable to transmit on one or more FM bands to provide communication through a FM radio.

One of ordinary skill in the art will appreciate that SCM (10) embodiments comprising communication technology can be remotely monitored (e.g. temperature, power being supplied, voltage level, current being supplied, power generator fuel level, etc.) and controlled (e.g. turned on/off change switching element status, etc.).

Switching Element

Still referring to FIG. 4, the switching element (28) is considered in more detail. The switching element defines a switching element input and a switching element output. The switching element input is electrically associated with (coupled to) the switching element output in response to a first switch-signal communicated to the switch-signal-input (33). When the switching element input is coupled to the switching element output such defines a switching element on-status where conductors from the input coupling element (12) is electrically associated with the output coupling element (14). When the switching element input is electrically isolated from said switching element output in response to a second switch-signal communicated to the switch-signal-input (33) such defines a switching element off-status where at least one conductor from the input coupling element (12) is electrically isolated from the output coupling element (14).

Exemplary embodiments of a switching element (28) include relays. A relay is an electrically operated switch. Many relays use an electromagnet to mechanically operate a switch, but other operating principles are also used, such as solid-state relays. The type of switch-signal used to control the switching element (28) will depend on the switching technology used. For example, the first switch-signal and the second switch-signal may be identical and simply causes the switching element (28) to change states or toggle. Alternatively, the first switch-signal may be different from the second switch-signal. For example, switch element (28) may be a simple relay and the first switch-signal may be the presence of a voltage and the second switch-signal may be the absence of a voltage.

As noted above, for the currently preferred embodiment, the processing device (30) is electrically associated with the switch-signal-input (33) defined by switching device (28) and is configured to generate a switch-signal to alter said switching element status based on a signal received from the leakage detector (26) or voltage/load detection circuit (36). For embodiments comprising communication functionality, processing device (30) may alter the switching element status based on a signal received from a remote electronic device.

Module Power Source

One of ordinary skill in the art will appreciate that the voltage supplied by the power generator (11) will generally be a 120 V alternating current. Most digital components operate on a smaller voltage and direct current (i.e. DC as opposed to AC). For such configurations a module power source (32) is required to power the digital components of the SCM (10). Such power source may be one or more batteries which may be rechargeable and recharged, for example, by power generator (11). Such power source (32) may be circuitry configured to convert the 120-volt alternating current power to a direct current power compatible with the SCM (10) digital components. Such circuitry is well known in the art and a detailed description thereof is not the to provide an enabling disclosure.

Load Detectors

One optional safety feature that may be incorporated into the SMC (10) device is load detection circuitry (36). For such embodiment, the processing device uses a signal such as a voltage signal to determine if there is a load associated with the output coupling element (14). If there is no load, the impedance between the hot and neutral conductor should approach infinity (for an open circuit). When there is a load associated with the output coupling element (14) the impedance between the hot and neutral conductor should be significantly less than infinity. The processing device (30) generates the necessary signal to check the impedance between the hot conductor and the neutral conductor and disables (turns off) the switching element when the impedance between the hot conductor and the neutral conductor is a first value or within a first range of values (e.g. infinity or very large). The processing device (30) enables (turns on) the switching element when the impedance between the hot conductor and the neutral conductor is a second value or within a second range of values (e.g. much less than infinity). Preferably, one of the status indicators (24) would generate a light-based signal to indicate the load status at the output coupling element (14).

Linear Coupling Module

Figure 5:
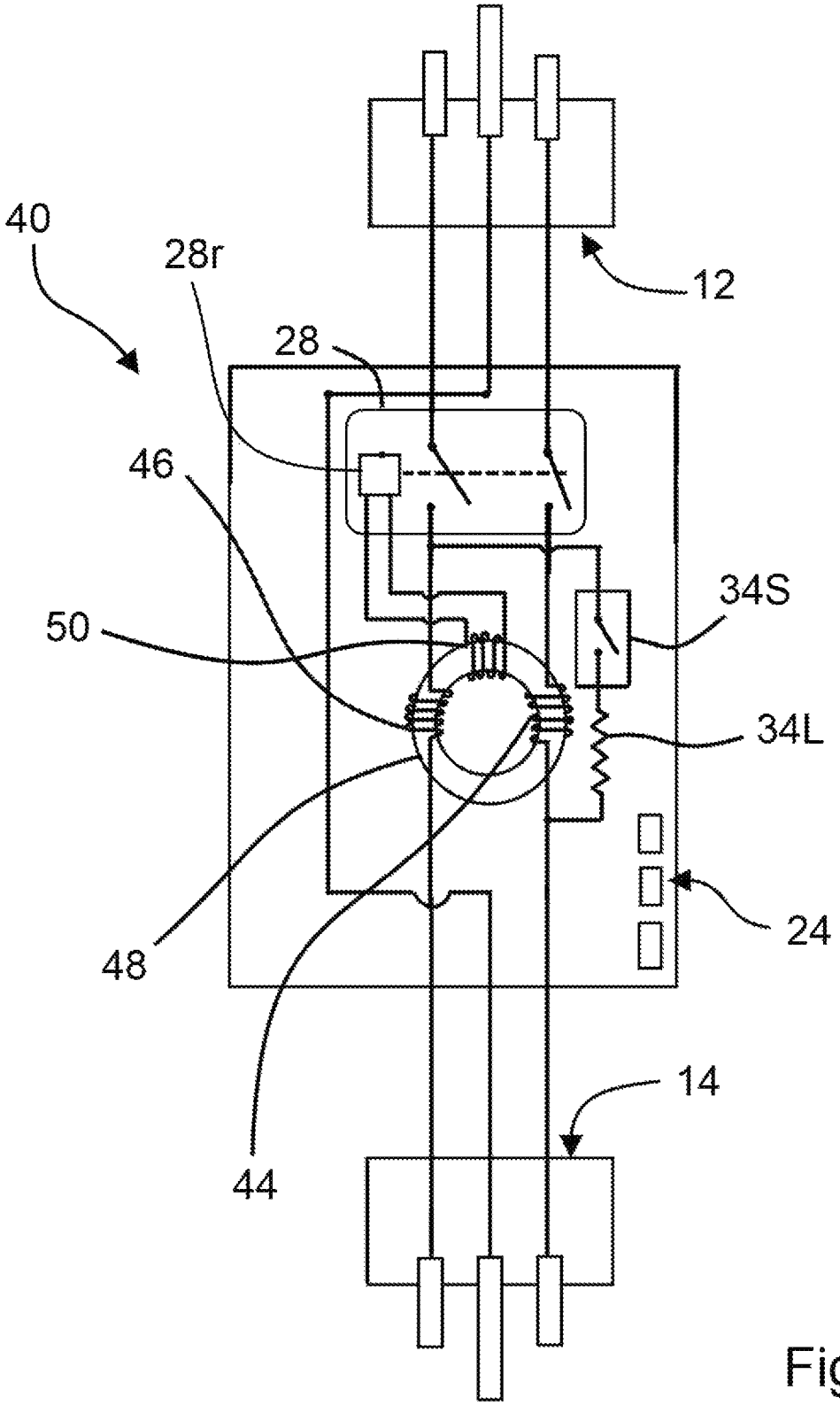
FIG. 5 is a block diagram representation of a linear coupling module.

Referring now more particularly to FIG. 5, exemplary embodiments of a Linear Coupling Module (LCM) (40) are examined. The LCM (40) is referred to as a linear module as it does not use smart digital technology such as a processing device. Alternatively, LCM (40) could simply be considered a "coupling module" as opposed to a "smart coupling module". Similar to the way the smart coupling module is configured, the LCM (40) comprises a module housing defining an input coupling element (12) and an output coupling element (14) electrically associated by a plurality of module conductors comprising at least a hot conductor, a neutral conductor and a ground conductor (for 120-volt services; two hot conductors for a 240-volt service). The input coupling element (12) is configured for being removably associated with a power generator output (11) and the output coupling element is configured for being removably associated with an electric circuit interface (7*a*, 7*b*). As with the smart coupling module (10), the hot conductor and the neutral conductor are electrically associated with a leakage current detector element (48) and a switching element (28) defining a switching element input and a switching element output and a switch-signal-input. At least one of said hot conductor and said neutral conductor are electrically associated with said switching element input thereby defining at least one switched-conductor. Further, the module conductors not connected to said switching element input (or not switched by the switching element) each define a unswitched-conductor.

As before, the switching element input is electrically associated with the switching element output in response to a first switch-signal communicated to said switch-signal-input thereby defining a switching element coupled-mode (on status) and wherein said switching element input is electrically isolated from the switching element output in response to a second switch-signal communicated to the switch-signal-input thereby defining a switching element uncoupled-mode (off statue). The switching element output and the unswitched-conductors are electrically associated with the output coupling element (14). As before, the input coupling element (12) and the output coupling element (14) each define male coupling elements.

As with the digital embodiment, the currently preferred coupling module (40) comprising a toroid core (48) associated with a hot conductor winding (44), a neutral conductor winding (46) and leakage winding (50). The hot conductor winding (44) and neutral conductor winding (46) generate equal but opposite flux lines when the current through both conductors are equal. When the current through both conductors is not equal, such difference in current is called leakage current and such leakage current generates a voltage in the leakage winding (50). Restated, the leakage winding (50) detects the difference in current. When the leakage current reaches a predefined level, the switching element (28) engages and breaks the electrical association between the hot conductor and the neutral conductor (the switching element output) from the power source. Such detection circuits are known in the art but have not been used in the application described herein. Such configuration would work for a 240-volt configuration as described above.

A switch level adjustment element (e.g. a potentiometer) may be associated with the leakage winding circuit so that the leakage level needed to trip the switching element is adjustable.

The test circuit (34) comprises a test circuit switch (34S) and a test circuit load (34L). Notably the conductor segments between the leakage current detector and the module output element of the coupling module (40) can be referred to as the output side of conductors or the output side of the module. Similarly, the conductor segments between the module input element and the leakage current detector can be referred to the input side conductors or the input side of the module. When the test circuit switch (34S) is pressed a current from the output side of the hot conductor coil (44) flows through load (34L) and returns to the input side of the neutral coil (46). Thus, such test current does not flow through the neutral coil (46) thereby creating a "imbalance" or delta current between the hot conductor coil (44) current compared to the neutral coil (46) current. Such delta current is detected by leakage winding (48) which actuates the switching element (28) thereby breaking the electrical association between the hot conductor and the power generator and the neutral conductor and the power generator for embodiments were both conductors are switched. Pressing reset switch (28R) resets the coupling module (10) (switch 28) by reconnecting/coupling the hot conductor and the neutral conductor with the power generator.

Mechanical Coupling Adapter

Figure 3A:
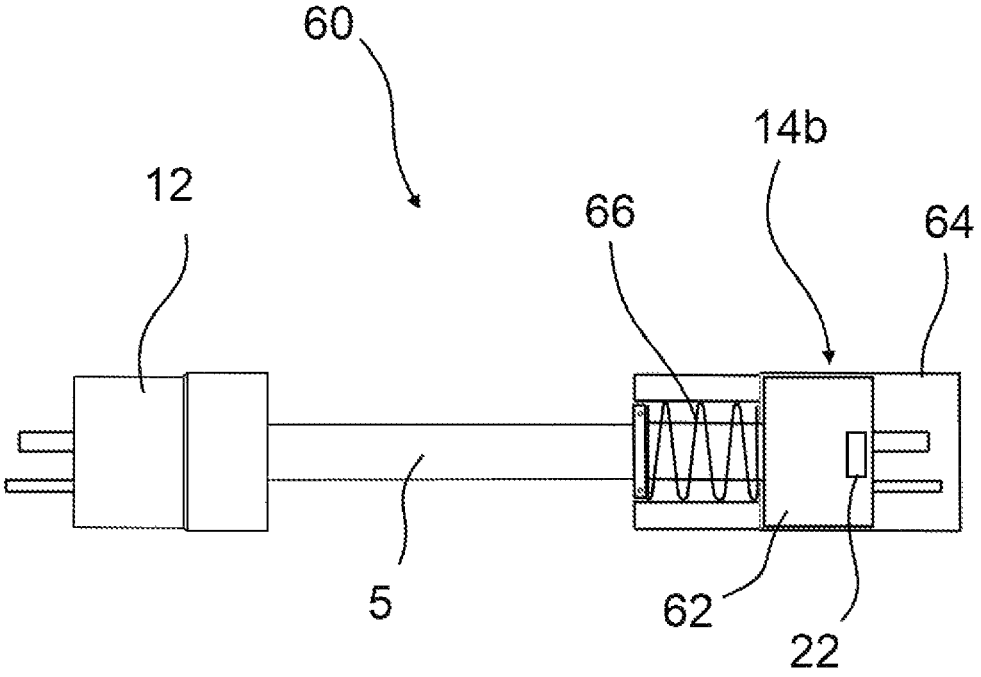
FIG. 3*a* is a side elevational view of a coupler adapter with mechanical safety features.
Figure 3B:
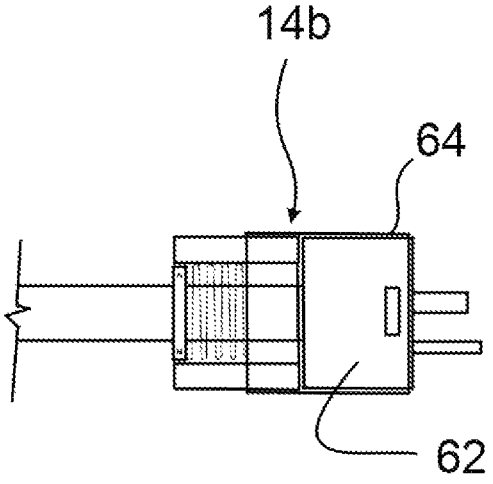
FIG. 3*b* is a side elevational view of a coupler adapter with mechanical safety features with exposed conductors.

Referring now more particularly to FIG. 3*a* and FIG. 3*b*, one exemplarily embodiment of a mechanical based coupling adapter (60) for coupling a power generator output interface to an electric circuit output interface is presented. In contrast to the smart coupling module (10) and the linear coupling module (40), coupling adapter (60) relies on mechanical elements to supply the safety features. The coupling adapter (60) comprises a first coupling element (12) electrically associated with a second coupling element (14) through a cable (5) comprising a plurality of adapter-conductors. As before, the adapter-conductors comprise at least three conductors (e.g. a hot conductor, a neutral conductor and a ground conductor). For this embodiment however, at least one of the first coupling element (12) and the second coupling element (14) define a mechanical safety feature such as retractable coupling element housing (14*b*) or perhaps a simple recessed portion that the male conductors are "recessed" into to limit access to the conductors. As depicted in FIG. 3A, for the currently preferred embodiment, only the second coupling connector defines a safety feature comprising a retractable coupling element housing (14*b*) although both connectors could both comprise such features. As before, the first coupling element and the second coupling element each define a male coupling element configured to be removably associated with a female interface.

The retractable coupling element housing (14*b*) defines a first safety-mode configured to restrict access to the adapter-conductors as depicted in FIG. 3*a*. The retractable coupling element housing (14*b*) further defines and a second live-mode configured to allow access to the adapter-conductors as depicted in FIG. 3*b*. Consequently, the first safety-mode restricts access to the adapter-conductors whereas the second live-mode does not materially restrict access to the adapter-conductors. For the live-mode, the retractable coupling element housing (14*b*) comprises a slider element (64) and a base element (62) where the slider element is configured to slide along the base element (62) to allow access to the coupler-conductors. For such embodiment the slider element is biased in the previously described safety-mode position by resilient element (66). As before the coupling elements may define a status indicator, such as a light emitter, configured to emit light when there is a voltage present at the associated conductors.

For one alternative embodiment, the mechanical coupling adapter may be augmented by an electric safety feature. For such embodiment, an electric solenoid (or similar electronic element) is associated with the retractable coupling element (14*b*) and prevents movement of the retractable coupling element (14*b*) when there is power available at the retractable coupling element (14*b*). Basically, such a solenoid would be configured to prevent the slider element (64) from moving to the "live-mode" once power is applied to input coupling element (12). Thus, the goal is to require a user to plug output coupling element (14*b*) into a socket before associating the input coupling (12) to a power source. Of course, if both the input coupling element (12) and the output coupling element (14) are not configured with the mechanical safety features, someone will connect the "output coupling element" with the safety features into a life power source which would leave the "input coupling element" with live exposed wires. Thus, the mechanical safety features should be defined by both the input and output coupling elements.

Figure 6:
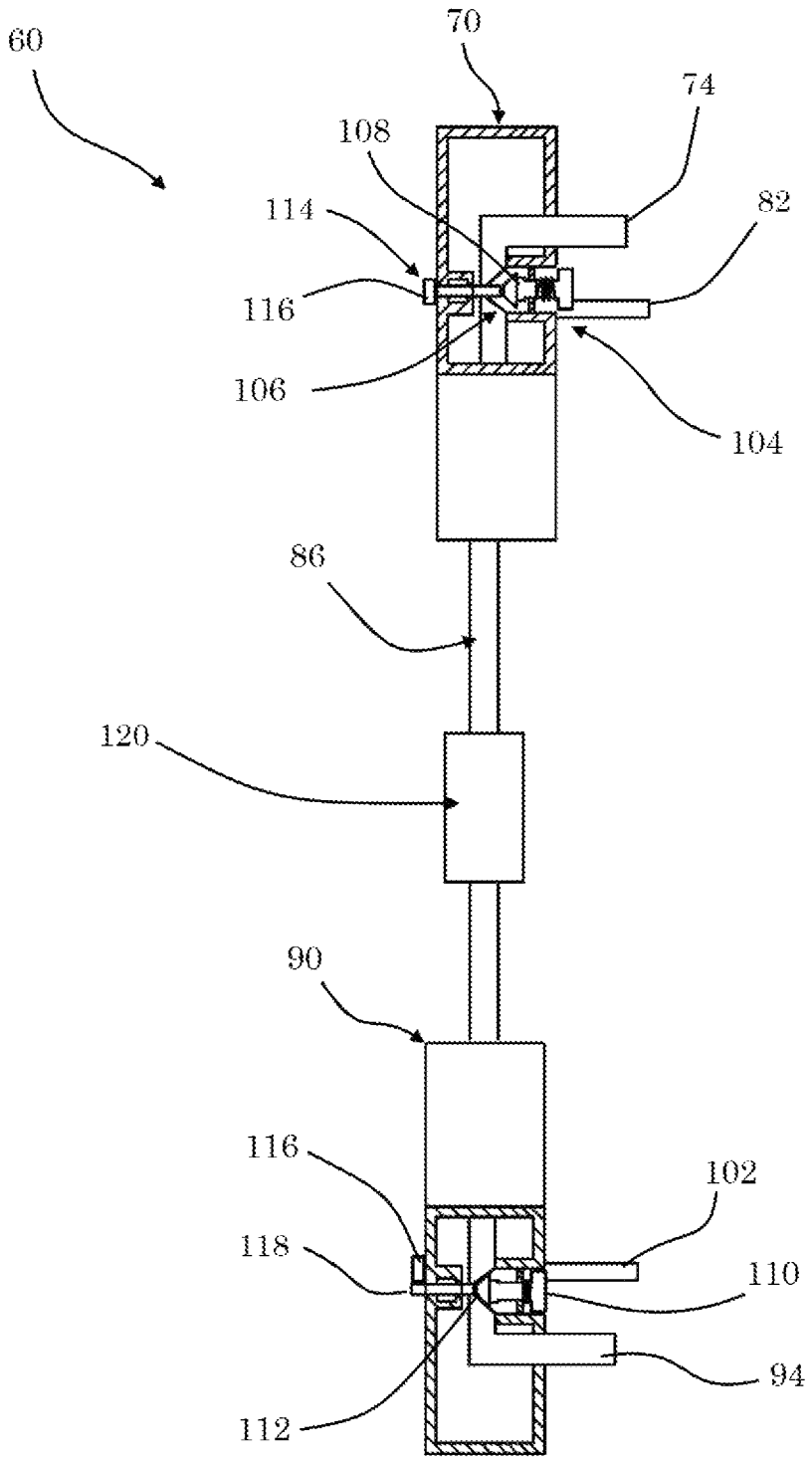
FIG. 6 is a side elevational view of an alternative embodiment of a male-to-male adapter with a partial cut-away section comprising mechanical safety features.
Figure 7:
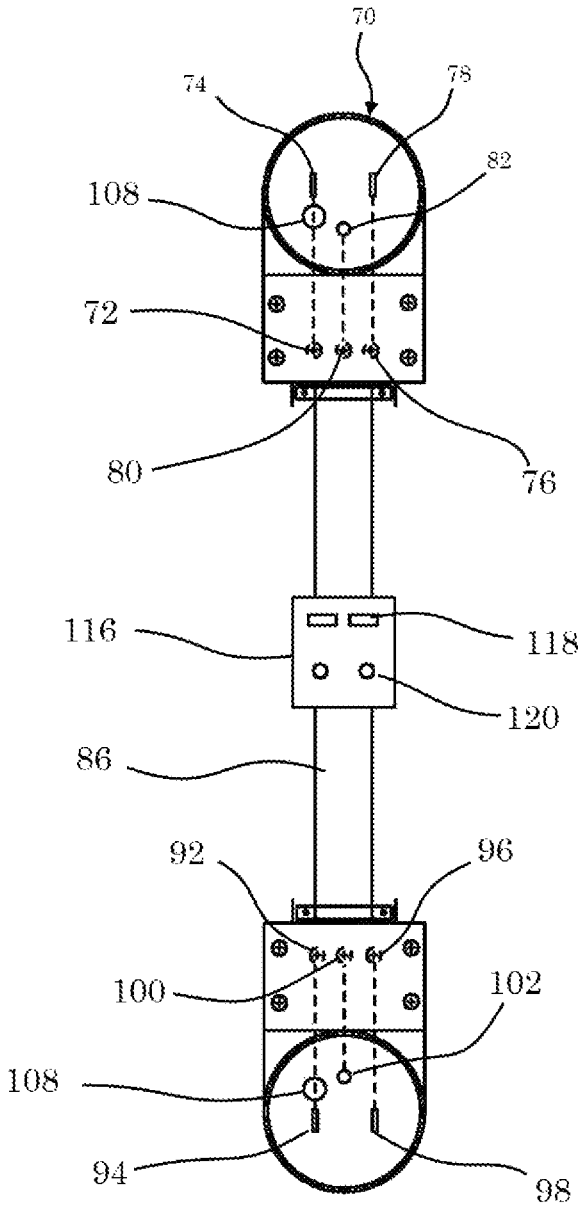
FIG. 7 is a top plan view of the apparatus depicted in FIG. 6.
Figure 8:
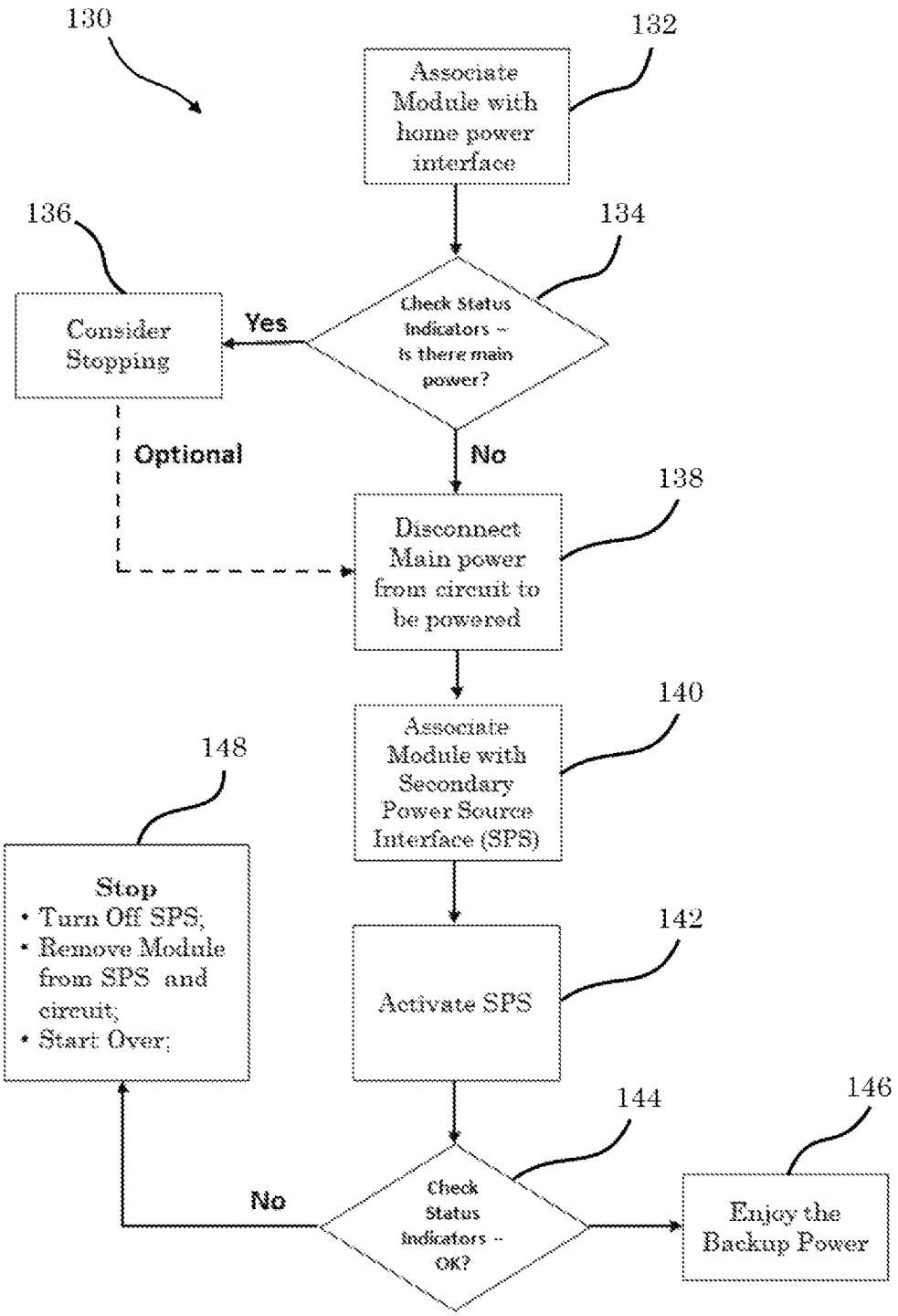
FIG. 8 is a block diagram representation of one exemplary method of using the disclosed inventions.

Referring now more particularly to FIG. 6 and FIG. 7, one alternative embodiment of a coupling adapter with mechanical safety features is presented. Here, the coupling adapter (60) is referred to as a coupling module (60) for coupling the output of a power generator interface (11) to an electric circuit interface (7). As best seen in FIG. 7, the coupling module (60) comprises a first element (70) defining a hot terminal first end (72) and a hot terminal second end (74), a neutral terminal first end (76) and a neutral terminal second end (78) and a ground terminal first end (80) and a ground terminal second end (82) wherein the second ends (74, 78, 82) of said first element (70) are configured for being electrically associated with a first power circuit. Such first power circuit could be a power interface (11) or an electrical circuit interface (7) as described above.

The coupling module (60) further comprises a second element (90) defining a hot terminal first end (92) and a hot terminal second end (94), a neutral terminal first end (96) and a neutral terminal second end (98) and a ground terminal first end (100) and a ground terminal second end (102). As with the first element (70), the second ends (94, 98, 102) of the second element (90) are configured for being electrically associated with a second power circuit such as a power interface (11) or an electrical circuit interface (7) as described above.

A cable (86) comprises a hot conductor, neutral conductor and a ground conductor. The hot conductor is electrically associated with the first end (72) of the hot terminal for the first element (70) and is further electrically associated with the first end (92) of the hot terminal for the second element (90). The neutral conductor is electrically associated with the first end (76) of the neutral terminal for the first element (70) and is further electrically associated with the first end (96) of the neutral terminal for the second element (90). Similarly, a ground conductor is electrically associated with the first end (80) of the ground terminal for the first element (70) and is further electrically associated with the first end (100) of the ground terminal for the second element (90).

For at least one of the first element (70) and the second element (90), the hot terminal defines a safety feature defined by a continuity-interface (104) disposed between the hot terminal second end (74) and the hot terminal first (72). The continuity-interface (100) is configured to electrically isolate the hot terminal first end (72) from the hot terminal second end (74) when the second ends (74, 78, 82) are not associated with a power circuit. Such state is depicted by the first element (70) in FIG. 6.

The continuity-interface (104) is further configured to electrically couple the hot terminal first end (72) with the hot terminal second end (74) when the second ends (74, 78, 82) are associated with a power circuit as depicted by the second element in FIG. 6 (although the power circuit is not shown). One embodiment of a continuity-interface (104) comprises an electrical gap (106) in the hot terminal when the second ends (74, 78, 82) are not associated with a power circuit. The continuity-interface (104) is configured to receive a conductive plug (108) configured to bridge the electrical gap (106) when the second ends are associated with a power circuit.

Ideally the exposed portions of the conductive plug (108) are not conductive so that live power is not present at the exposed portions. The portion of the conductive plug (108) that engages with the electrical gap (106) would be a conductive portion (112) thereby electrically bridging one side of the electrical gap with the opposing side thereby completing the electrical connection between the first end (92) and the second end (94). The conductive plug (108) is associated with a resilient element (110) configured to bias the conductive plug (108) in a position that does not bridge the electrical gap (106) when the second ends are not associated with a power circuit (as depicted by first element (70) in FIG. 6).

An optional safety feature is to provide an inhibitor element (114) configured to selectively prevent the conductive plug (108) from bridging the electrical gap (106). For one embodiment, the inhibitor element (114) comprises a blocking element (116) and a rod element (118). The rod element extends from the outer surface of the first element (70) to said conductive plug (108). When blocking element (116) is in a first position as depicted by first element (70), the rod element (118) cannot be moved passed the outer surface of the first element (70) which prevents conductive plug (108) from engaging with continuity-interface (104).

For yet another embodiment, the rod element (118) defines at least one of (a) a rod comprising a lighting element and (b) a rod defining a light pipe. For this embodiment, when there is live power at the continuity-interface (104) and the conductive plug has engaged the continuity-interface (104), a light signal is generated so that light is transferred from such lighting element to the exposed end of the rod element (118) ("exposed" end means the end extending beyond the outer surface of first element (70)).

The coupling adapter (60) may further comprise a status element (116) disposed along the cable (86) electrically connecting the first element (70) with the second element (90). Such status element (120) may comprise one or more status indicators (118) to indicate the electrical status of the coupling adapter (60). For example, one status indicator may illuminate when there is power associated with the conductor connecting the hot terminals of the first and second element (70, 90). Additional switches (120) may be used to selectively isolate and couple the first element (70) from the second element (90).

One of ordinary skill in the art will further appreciate that features of the smart adapter, coupling adapter and coupling module can be incorporated into a power source so that such power source provides a male output power circuit. Ideally the smart adapter technology would be used so that the male output power circuit would not become "live" until the apparatus determined the male output power circuit has been coupled to an appropriate external device or circuit as described above and would preferably power down when leakage current is detected.

Method for Using

Attention is now directed to the methods of using the disclosed inventions. As noted previously, the various coupler adapters are intended to be used to connect a power source to an electric circuit. For example, the disclosed adapters may be used to connect the output of a generator to the outlet associated with a power grid in a residential home and such example is used to explain exemplary methods of using the disclosed inventions.

The Connection Method (130) is now examined. The first step (132) is to connect the output side of coupling element (14) of the coupling module (10) (configured with status indicators) to the circuit (7) to be powered by a secondary power source. The input coupling (12) can be connected to the secondary power source but the secondary power source should be OFF. Check the module status indicators (step 134) to verify there is no power being supplied by the main power source. If the status indicators indicated there is main power consider stopping (step 136) as a backup power source may not be needed. If one wishes to continue, go to the next step for the condition where no power is present and disconnect utility power (138) from the affected power grid (e.g. home power grid). Such can be done by "flipping" the main breaker or the individual breaker(s) that supply power to the home circuits to be connected to the backup power source. As an additional precaution, one can do both (i.e. flip the main breaker and the specific breaker associated with the circuit to be powered by a secondary power source). Such step prevents utility power from being applied to a home power grid when such home power grid is connected to a secondary power source. The next step (140) is to electrically associate the input coupling element (12) with the output (11) of a secondary power source (if not already connected). Preferably the secondary power source is not supplying power to such output when the input coupling element (12) is first associated with such output. The secondary power source is then activated (step 142) and configured to supply power to the input coupling element (12) causing the input coupling element status indicator to generate a light-based signal indicating that there is power available at the input coupling element (12). The next step (144) is to check the module status indicators. When there is power available at the input coupling element (12) and there are no circuit faults in the coupling adapter (10), the output coupling element (14) should also have power available as indicated by the output coupling element (14) status indicator and one can enjoy the backup power (step 146).

If, however, there is no power at the output coupling element (14) the coupling adapter (10) should be reset. If the coupling adapter (10) has been reset and there still is no power at the output coupling element (14) stop and verify connections (step 148). Verify that the no load status indicator is not generating a light-based signal indicating no load. If the no load status indicator is generating a light-based signal, verify that the circuit to be powered is associated with a load such as a light and/or an electrical appliance.

For embodiments where coupling adapter (10) is in communication with a wireless network, for example, the coupling adapter (10) may be monitored and controlled using an application executed on a computing device such as a smart phone, laptop computer, desktop computer (to name a few). Such smart phone applications, for example, would generate a page presenting information about the power generator such as model, electrical specifications, real-time voltage level, real-time current being generated, and/or real-time power being generated, fuel level status, and coupling adapter (10) status. For such embodiment, the power generator would either communicate directly to the smart phone or communicate its status to the coupling module (10) which in turn presents such status information to the smartphone application for user viewing.

Finally, it will be appreciated by one of ordinary skill in the art that the above module features could be integrated into a generator design where the generator provides a "male" output equipped with the disclosed safety features.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

What is claimed is:

1. A coupling module for coupling the female output of a power generator interface to a female electric circuit interface, said coupling module comprising:

a first element defining a hot terminal first end and a hot terminal second end wherein the hot terminal second end extends at least partially outside of said first element, a neutral terminal first end, and a neutral terminal second end wherein the neutral terminal second end extends at least partially outside of said first element and a ground terminal first end and a ground terminal second end wherein the ground terminal second end extends at least partially outside of said first element wherein the hot terminal second end, the neutral terminal second end, and the ground terminal second end collectively define the first element second ends configured for being electrically associated with an external power circuit;

a second element defining a hot terminal first end and a hot terminal second end wherein the hot terminal second end extends at least partially outside the said second element, a neutral terminal first end and a neutral terminal second end wherein the neutral terminal second end extends at least partially outside the said second element and a ground terminal first end and a ground terminal second end wherein the ground terminal second end extends at least partially outside the said second element wherein the hot terminal second end, the neutral terminal second end, and the ground terminal second end collectively define the second element second ends configured for being electrically associated with an external power circuit;

a hot conductor electrically associated with the first end of the hot terminal for said first element and further electrically associated with the first end of the hot terminal for said second element;

a neutral conductor electrically associated with the first end of the neutral terminal for said first element and further electrically associated with the first end of the neutral terminal for said second element;

a ground conductor electrically associated with the first end of the ground terminal for said first element and further electrically associated with the first end of the ground terminal for said second element;

a continuity-interface disposed between the hot terminal second end and the hot terminal first end for said first element;

an electrical gap defined by said continuity-interface wherein said electrical gap electrically isolates the hot terminal first end from the hot terminal second end and wherein said electrical gap is configured to receive a conductive plug;

a conductive plug configured to bridge said electrical gap when said first element second ends are associated with an external power circuit;

a resilient element configured to bias said conductive plug in a position that does not bridge said electrical gap;

an inhibitor element defining a rod extending from an outer surface of said first element to said conductive plug wherein said inhibitor element is configured to prevent said conductive plug from bridging said electrical gap when said inhibitor element is activated;

wherein said rod is at least one of (a) a rod comprising a lighting element or (b) a rod defining a light pipe configured to transfer light from a lighting element and wherein said rod generated a light signal when said conductive plug is bridging said electrical gap and there is power available at said hot terminal;

wherein said continuity-interface electrically couples the hot terminal first end with the hot terminal second end when said electrical gap is receiving said conductive plug; and wherein said continuity-interface is not coupling the hot terminal first end with the hot terminal second end when said electrical gap is not receiving said conductive plug.

2. A coupling module for coupling the female interface of a power generator to a female interface of an electric circuit, said coupling module comprising:

a first male connector comprising:

a hot terminal defining a hot terminal enclosed end and a hot terminal exposed end;

a neutral terminal defining a neutral terminal enclosed end and a neutral terminal exposed end;

a ground terminal defining a ground terminal enclosed end and a ground terminal exposed end; and wherein the hot terminal exposed end, the neutral terminal exposed end, and the ground terminal exposed end are configured for being electrically associated an external power circuit;

a second male connector comprising:

a hot terminal defining a hot terminal enclosed end and a hot terminal exposed end;

a neutral terminal defining a neutral terminal enclosed end and a neutral terminal exposed end;

a ground terminal defining a ground terminal enclosed end and a ground terminal exposed end; and wherein the hot terminal exposed end, the neutral terminal exposed end, and the ground terminal exposed end are configured for being electrically associated with an external power circuit;

a hot conductor electrically connecting the hot terminal enclosed end of said first male connector to the hot terminal enclosed end of said second male connector;

a neutral conductor electrically connecting the neutral terminal enclosed end of said first male connector to the neutral terminal enclosed end of said second male connector;

a ground conductor electrically connecting the ground terminal enclosed end of said first male connector to the ground terminal enclosed end of said second male connector;

a continuity-interface defined by the hot terminal of said first male connector that electrically isolates the hot terminal exposed end of said first male connector from the hot terminal enclosed end of said first male connector when said first male connector is not connected to an external power source;

an inhibitor element configured to prevent said continuity interface from electrically associating the hot terminal exposed end of said first male connector with the hot terminal enclosed end of said first male connector when said inhibitor element is engaged; and wherein said continuity-interface electrically couples the hot terminal exposed end of said first male connector with the hot terminal enclosed end of said first male connector when the hot terminal of said first male connector is electrically associated with an external power circuit and said inhibitor element is not engaged.

3. A coupling module as in claim 2, wherein said continuity-interface comprises an electrical gap electrically isolating the hot terminal exposed end of said first male connector from the hot terminal enclosed end of said first male connector when said first male connector not associated with an external circuit.

4. A coupling module as in claim 3, wherein said continuity-interface defines a conductive plug configured to bridge said electrical gap thereby defining a first coupled position when said first male connector is associated with an external power circuit and wherein said conductive plug is configured to not bridge said electrical gap thereby defining a second uncoupled position when said first male connector is not associated with an external power circuit.

5. A coupling module as in claim 4, wherein said continuity-interface further comprises a resilient element configured to bias said continuity-interface in said uncoupled position when said first male connector is not associated with an external power circuit.

6. A coupling module as in claim 5, wherein said inhibitor element prevents said conductive plug from moving to said coupled position when said inhibitor element is engaged and allows said conductive plug to move into said coupled position when said inhibitor element is disengaged.

7. A coupling module as in claim 4, wherein said inhibitor element defines a rod extending from the outer surface of said first male connector to said conductive plug.

8. A coupling module as in claim 7, wherein said rod is at least one of (a) a rod comprising a lighting element or (b) a rod defining a light pipe configured to transfer light from a lighting element and wherein said rod generates a light signal when said conductive plug is bridging said electrical gap and there is power available at the hot terminal of said first male connector.

9. A coupling module as in claim 2, wherein the hot terminal of said second male connector defines a second continuity-interface that electrically isolates the hot terminal exposed end of said second male connector when the hot terminal exposed end of said second male connector is not electrically associated with an external power circuit; and wherein said second continuity-interface electrically couples the hot terminal exposed end of said second male connector with the hot terminal enclosed end of said second male connector when the hot terminal exposed end of said second male connector is electrically associated with an external power circuit.

* * * * *